United States Patent [19]

Kratt et al.

[11] 4,441,471

[45] Apr. 10, 1984

[54] APPARATUS FOR REGULATING THE IDLING RPM OF INTERNAL COMBUSTION ENGINES

[75] Inventors: Alfred Kratt, Trossingen; Bernd Kraus, Gerlingen; Günther Plapp, Filderstadt, all of Fed. Rep. of Germany

[73] Assignee: Robert Bosch GmbH, Stuttgart, Fed. Rep. of Germany

[21] Appl. No.: 313,074

[22] Filed: Oct. 19, 1981

[30] Foreign Application Priority Data

Oct. 18, 1980 [DE] Fed. Rep. of Germany ..... 3039435

[51] Int. Cl.[3] ..... F02D 11/10

[52] U.S. Cl. ..... 123/339; 123/340

[58] Field of Search ..... 123/179 BG, 339, 340

[56] References Cited

U.S. PATENT DOCUMENTS

| | | | |
|---|---|---|---|
| 3,960,130 | 6/1976 | Peterson | 123/339 |
| 4,106,451 | 8/1978 | Hattori | 123/339 |
| 4,186,697 | 2/1980 | Yasuda | 123/339 |
| 4,237,833 | 12/1980 | Des Lauriens | 123/339 |
| 4,291,656 | 9/1981 | Miyagi | 123/339 |
| 4,303,048 | 12/1981 | Nishio | 123/339 |
| 4,344,398 | 8/1982 | Ikeura | 123/339 |

*Primary Examiner*—Ronald B. Cox

*Attorney, Agent, or Firm*—Edwin E. Greigg

[57] ABSTRACT

An apparatus is proposed for regulating the idling rpm of internal combustion engines with externally supplied ignition. The apparatus includes a comparison circuit for set-point and actual rpm, and the idling rpm set-point value can be influenced in accordance with the actual rpm, time, operating voltage, temperature, and other variables as needed. The actual regulation is effected by means of a PID-regulator, whose individual characteristics may be established for processing data as desired, preferably in accordance with the rpm deviation. A limitation regulator furthermore serves to establish the respective maximum and/or minimum limitation of the adjustment member in accordance with operating characteristics.

10 Claims, 8 Drawing Figures

APPARATUS FOR REGULATING THE IDLING RPM OF INTERNAL COMBUSTION ENGINES

BACKGROUND OF THE INVENTION

As regulations pertaining to exhaust composition become ever stricter, the regulation of the idling rpm also acquires increasing significance. What is critical in this respect is that it should no longer be possible for just anyone to change the idling rpm setting; for this reason, it becomes necessary to assure that there will be reliable idling over a relatively long period of engine operation.

The provision of an electromagnetic adjusting element in a bypass conduit around the throttle valve is known as a means of attaining regulation of the idling rpm, this adjusting element being triggerable in accordance with rpm and temperature. Another known solution to this problem omits this separate bypass conduit; instead, a specialized adjusting element prevents the complete closure of the throttle valve, accordingly establishing the desired opening cross section for idling. Generally, these known devices function satisfactorily; however, they are not capable of meeting the demand for extreme precision under all conceivable operating conditions.

OBJECT AND SUMMARY OF THE INVENTION

The apparatus according to the invention, intended for regulating the idling rpm in internal combustion engines having externally supplied ignition, enables the attainment of the required precision of the initial setting, so that even over a long period in operation favorable exhaust emission values are attainable. It has proved to be particularly advantageous to take into account the variables for operating voltage, time, rpm and a gear-changing signal, for example, in processing the signal for the electromagnetic adjusting element. Rapid regulation is furthermore attained particularly because of the fact that the individual regulating elements, with proportional, integral and differential behavior, have a non-linear characteristic.

The invention will be better undestood and further objects and advantages thereof will become more apparent from the ensuing detailed description of a preferred embodiment taken in conjunction with the drawings.

DESCRIPTION OF THE PREFERRED EMBODIMENT

Figure 1:
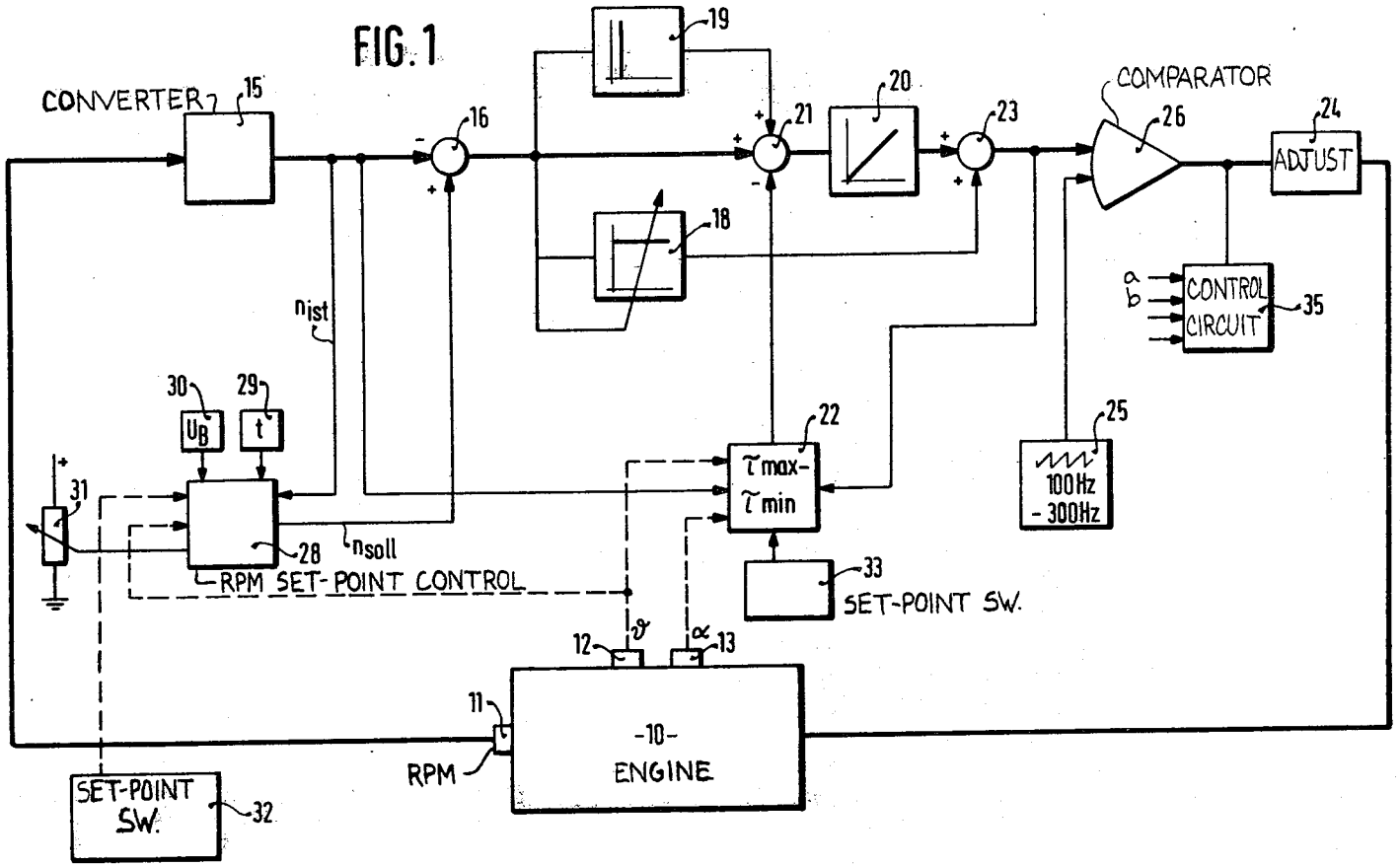
FIG. 1 is a block circuit diagram of apparatus for regulating the idling rpm value in an internal combustion engine with externally supplied ignition according to a best mode and prepared embodiment of the present invention.

The exemplary embodiment relates to an apparatus for idling rpm regulation in an internal combustion engine with externally supplied ignition. In FIG. 1, an internal combustion engine 10 is shown which has associated with it receptors for measurement values for rpm 11, temperature 12 and throttle valve positional angle 13. The rpm signal from the measurement receptor 11 proceeds to a frequency-to-voltage converter 15 and then to a comparison point 16 for the comparison between set-point and actual rpm. The actual regulator follows, comprising three stages 18, 19 and 20 having proportional (P), differential (D) and integral (I) characteristics processing proportional, differential and integral data functions respectively. Between the comparison point 16 and the I-regulator 20, there is a further coupling point 21, which additively links the output of the D-regulator 19 with the output value of the comparator 16 and from this derives a limitation signal from a limitation regulator 22. Both the I-regulator 20 and the P-regulator 18 act at their output upon a linking element or coupling circuit 23. Its output signal in turn serves as a guide signal for an adjustment member 24; however, with a view to the desired clocking of the adjustment member, this adjustment member 24 is also coupled responsively through a comparator 26 with the output signal of a sawtooth generator 25, having a frequency in the range of approximately 100 to 300 Hz. On the output side, the adjustment member 24 acts upon the engine in such a manner that the desired idling rpm is produced by way of regulating the air throughput in the intake tube. Connected to adjustment member 24 is an adjustment member control circuit 35, which in addition to the regulating conditions discussed above, controls the adjustment member 24 in accordance with engine start (a) and overrunning (b).

The arrow in the block containing the P-regulator 18 points to one possible variation of the amplification factor, depending upon the level of the input signal. The integration constant of the I-regulator 20 can also be selected arbitrarily in the up and down directions as a function of the rpm deviation and of the temperature.

An rpm set-point control circuit 28, at its output side, furnishes a signal to the comparison point 16. The rpm set-point signal thereby made available is dependent upon the instantaneous rpm, the temperature, the time, the instant-from "N" to "D" with automatic transmissions. In order to be able to take all these variables into account, the rpm set-point control circuit 28 is responsively connected with the outputs of the frequency-to-voltage converter 15, the temperature transducer 12, a time transducer 29, and of course with the battery voltage source 30. A potentiometer 31 here serves to represent some means of establishing the desired set-point rpm. Finally, there is a set-point switch 32, whose position depends, for instance, on the gear engagement of the transmission such as mentioned above.

The limitation regulation 22 also receives not only an input signal from the output of the coupling circuit 23 for the actual regulating process, but also pulses relating to the rpm, temperature, and the throttle valve position at a particular time, as well as pulses from a set-point switch 33 which may, but need not necessarily, be identical with the set-point switch 32. What is important is that the limitation regulation should function both in the case of idling and when the throttle valve is open and should then control this limitation at least in accordance with rpm and temperature.

The realization of the individual elements and blocks shown in FIG. 1 does not present any difficulty to one skilled in the art; in fact, many of these are already available on the market.

Figure 2:
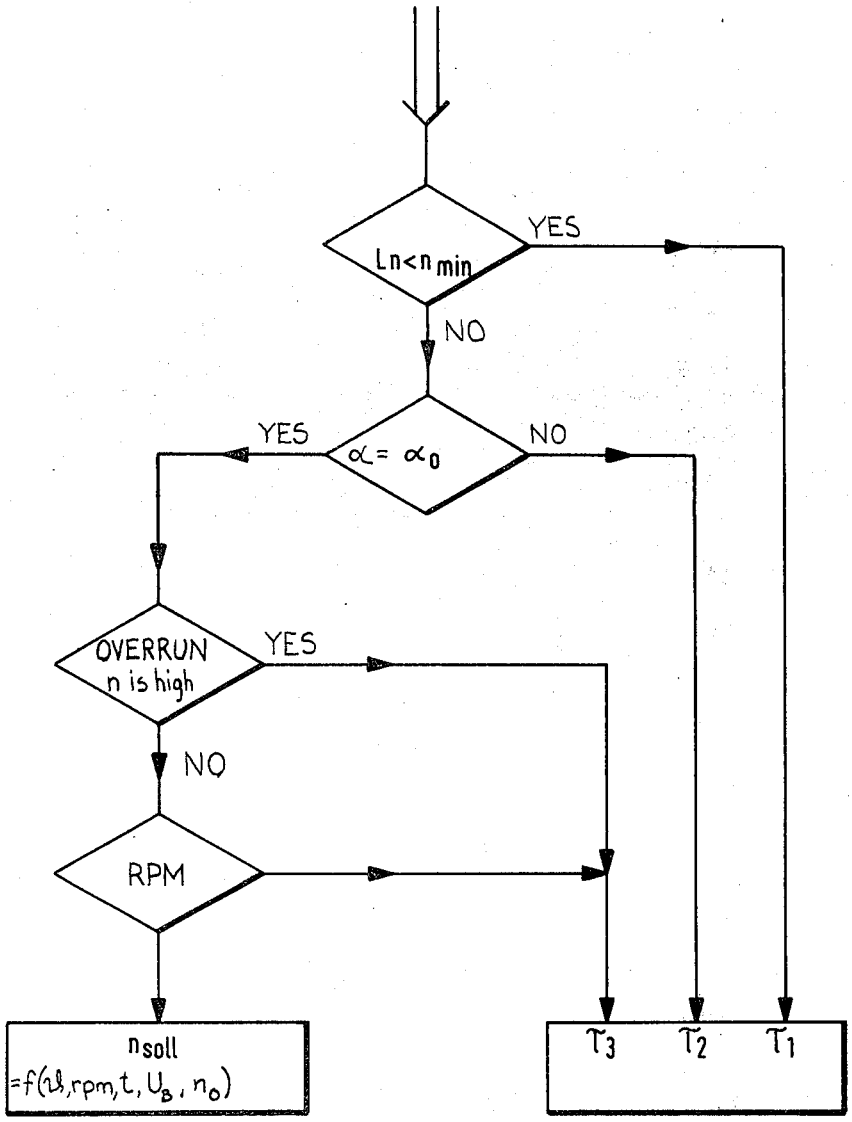
FIG. 2 is a flow diagram for the case where the regulation is used.

In the form of a flow diagram, FIG. 2 clearly shows how the apparatus for rpm regulation shown in FIG. 1 can operate. The flow diagram begins with an interrogation as to whether a starting process is occurring or not. At an rpm below a minimal value, this starting process does exist, and the adjustment member 24 should be triggered with pulses having the duty cycle of $\tau$ 1. Directly following the interrogation as to starting, there is an interrogation as to the position of the throttle valve switch. If this switch position indicates an open throttle valve, then normal driving is occurring, and the control of the adjustment member is effected with pulses having a duty cycle of $\tau$ 2. In the case where there is a bypass conduit around the throttle valve, the adjustment member is directed into a central position during normal driving, so that upon the transition to idling there is still play both upward and downward. In contrast to this, the bypass conduit is directed to be fully opened during starting, so that the engine will turn over readily.

When the throttle valve switch is closed, in turn, two operational states are possible: overrunning and idling. In the case of overrunning, the adjustment member 24 receives input signals having a duty cycle of $\tau$ 3; with a view to good engine braking, this causes the bypass conduit to be virtually completely closed, or else it provides so much supplementary air that good combustion is still maintained.

In order to attain still better regulation of the rpm from overrunning into the idling state, a further interrogation is made as to whether the rpm remains above the overrunning recognition threshold for longer than one second, for example. Only if this is the case should the actual idling rpm regulation take effect; in other words, the rpm set-point value should orient itself to at least one of the following variables: temperature, rpm, time, battery voltage, desired rpm set-point, and further switch positions.

Various desired functional courses are illustrated in the following drawings, FIGS. 3–6.

Figure 3:
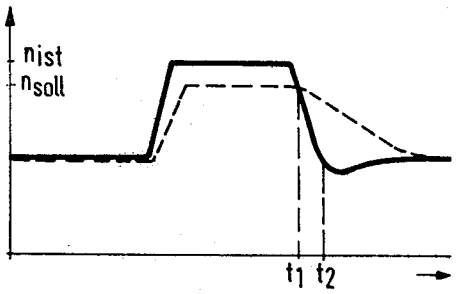
FIG. 3 illustrates the dependency of the set-point rpm on the actual rpm.

FIG. 3 illustrates the desired dependecy of the set-point rpm on the actual rpm. For example, the set-point is increased if the actual rpm is increased by more than approximately 100 rpm, as the result of the driver's actuation of the accelerator or gas pedal. This provision makes it easier to regulate the rpm to the stationary value following abrupt pumping of the gas pedal, if there is a delay in the follow-up of the increased set-point value to the stationary value, because in that case the regulator already responds at time t1 and does not wait until time t2 to respond. In this way, even slight underswings are prevented, and there is an improved sense of smoothness in the vehicle performance.

Figure 4:
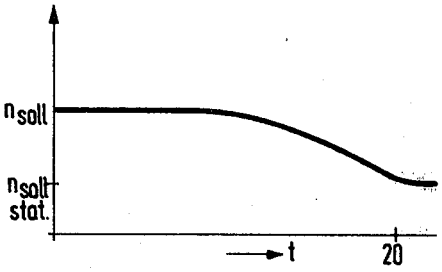
FIG. 4 illustrates the course of the set-point rpm over time; and, finally.

FIG. 4 illustrates one example for a time-dependent establishment of an rpm set-point value. In a concrete instance, a higher rpm set-point is desired directly following starting and for a specific period. The reason for this is that in the case of vehicles with $\lambda$ regulation, the $\lambda$ sensor should reach its operating temperature more rapidly; as a rule, this can be accomplished only by means of a higher rpm. It may be seen in the drawing that there is a constant range beyond a specific period of time, and following this there is a drop back to the normal value, which should be attained approximately 20 seconds after starting.

The purpose of making the rpm set-point value dependent on the operating voltage is that the charge balance of the battery is thereby improved, especially in the case where the battery voltage drops when electrical consumer accessories and load devices are switched on.

By way of the supplementary switch inputs for the rpm set-point which are provided, such as the set-point switch 32, it is possible to switch the rpm over to a different rpm set-point in order to assure quieter engine operation; an example of this might be the engagement of a particular gear. Another case where this would apply is switching on an air conditioning system. In this instance, again, there is a jump in engine load, and it is desirable to compensate for the jump by way of a variation in the idling rpm setting.

Figure 5A:
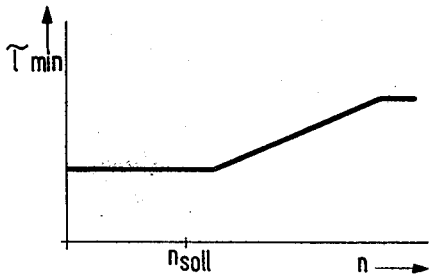
FIGS. 5*a*, 5*b*, 6*a* and 6*b* illustrate minimal or maximal limitations on the idling air flow in accordance with rpm and temperature.
Figure 5B:
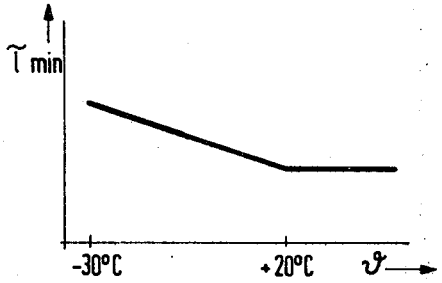
Figure 6A:
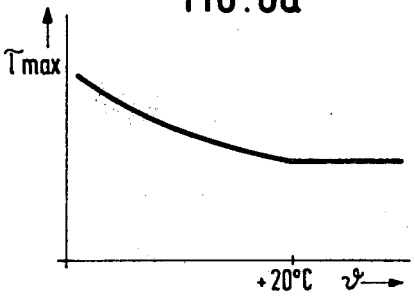
Figure 6B:
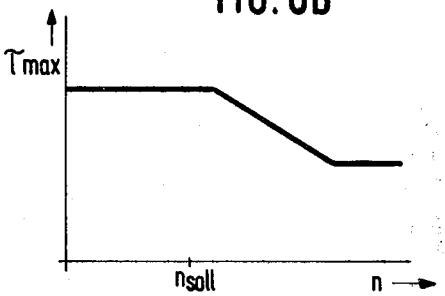

If the rpm is increased by the driver beyond the idling set-point, the regulator closes the adjustment member except for the minimum opening cross section specified in the regulator. This minimum opening cross section is selected with a view to good engine dynamics; that is, it is intended that the stationary idling rpm be attained smoothly, in accordance with the engine rpm and the engine temperature. The functional courses for this are shown in FIG. 5*a* and FIG. 5*b*. It may be seen from these figures that the minimum cross section is enlarged in the vicinity of a certain rpm and otherwise has a constant value. In corresponding fashion, this minimum cross section is enlarged at an increased rate as the temperature drops to relatively low levels, in order to attain good driving performance in the period following the start.

The full maximum opening cross section is required only at low temperatures. It can therefore be limited in accordance with temperature, as may be seen from FIG. 6*a*. There are resultant advantages in terms of overswings in rpm. However, such overswings can also be reduced by increasingly limiting the maximum cross section as the rpm increase. This may be seen in FIG. 6*b*. A duty cycle of $\tau$ max is plotted on the respective ordinate axes and is directly related to the respective opening cross sections.

All of the provisions discussed above assure that the instance of engine idling will be controlled reliably and precisely. This is advantageous with a view to the requirement for clean exhaust even during idling. A further advantage is that fuel consumption can be reduced to the minimum possible level, because since the fluctuations in idling rpm are regulated, it is no longer necessary to maintain wide margins of safety simply to keep the engine from stalling when there are jumps in load.

The foregoing relates to a preferred exemplary embodiment of the invention, it being understood that other embodiments and variants thereof are possible within the spirit and scope of the invention, the latter being defiend by the appended claims.

What is claimed and desired to be secured by Letters Patent of the United States is:

1. An apparatus for regulating the idling rpm of internal combustion engines whose rpm is controlled by a throttle means disposed in the intake tube, comprising:

an electromagnetically actuatable adjustment member for establishing the aspirated air quantity in the idling position of said throttle means, means providing an actual rpm value, means providing a desired idling rpm value, means at least temperature responsive providing an rpm set-point value dependent on said desired idling rpm value and said actual rpm value, wherein said rpm set-point value is selected in accordance with said actual rpm value whenever an rpm threshold of approximately 100 revolutions per minute above a stationary set-point value has been attained, and the retraction of the normal value occurs in accordance with a selectable function, a comparison means for said set-point rpm and actual rpm values, and a subsequent regulator means connected to the output of said comparison means including means for processing at least one of proportional, integral, and differential functions of said output of said comparison means for controlling said adjustment member.

2. An apparatus for regulating the idling rpm of internal combustion engines whose rpm is controlled by a throttle means disposed in the intake tube, comprising:

an electromagnetically actuatable adjustment member for establishing the aspirated air quantity in the idling position of said throttle means, means providing an actual rpm value, means providing a desired idling rpm value, means at least temperature responsive providing an rpm set-point value dependent on said desired idling rpm value and said actual rpm value, wherein said rpm set-point value is retracted in a time-dependent manner after starting, from a level which is elevated relative to a stationary value back to the stationary value, a comparison means for said set-point rpm and actual rpm values, and a subsequent regulator means connected to the output of said comparison means including means for processing at least one of proportional, integral, and differential functions of said output of said comparison means for controlling said adjustment member.

3. An apparatus for regulating the idling rpm of internal combustion engines whose rpm is controlled by a throttle means disposed in the intake tube, comprising:

an electromagnetically actuatable adjustment member for establishing the aspirated air quantity in the idling position of said throttle means, means providing an actual rpm value, means providing a desired idling rpm value, means at least temperature responsive providing an rpm set-point value dependent on said desired idling rpm value and said actual rpm value, and further dependent upon at least one of the following variables: time, supply voltage, and position of the gear engagement of the transmission, a comparison means for said set-point rpm and actual rpm values, and a subsequent regulator means connected to the output of said comparison means including means for processing at least one proportional, integral, and differential functions of said output of said comparison means for controlling said adjustment member.

4. A method for regulating the idling rpm of internal combustion engines where rpm is controlled by a throttle valve disposed in the intake tube and responsive to an adjustment member for establishing the aspirated air quantity in the idling position of said throttle means, comprising the steps of, providing at least a temperature responsive rpm set-point value dependent on a desired idling rpm value and an actual rpm value, and further dependent upon at least one of the following variables: time, supply voltage, and position of the gear engagement of the transmission comparing said set-point and actual rpm values, processing at least one of proportional, integral and differential functions of the output of said comparison step, and controlling said adjustment member in response to said processing step.

5. An apparatus as defined by claim 2, wherein said time dependency of said rpm set-point value lasts for approximately 20 seconds.

6. An apparatus as defined by claim 3, wherein said adjustment member includes limiting means for setting said adjustment member to minimum and maximum opening values, in accordance with rpm and temperature.

7. An apparatus as defined by claim 6, wherein at least in a predetermined range, said minimum opening increases with increasing rpm and said maximum decreases.

8. An apparatus as defined by claim 6, wherein said minimum and said maximum opening increase in the direction of low temperatures.

9. An apparatus as defined by claim 3, wherein said adjustment member comprises an adjustment member control circuit responsive to said processing means for controlling said adjustment member in accordance with starting and overrunning.

10. An apparatus as defined by claim 3, wherein said regulator means comprises a variable input means.

* * * * *